United States Patent [19]

Uchida et al.

[11] 4,037,060

[45] July 19, 1977

[54] STEREOPHONIC PICKUP CARTRIDGE

[75] Inventors: Ryuichi Uchida, Fussa; Kaoru Terasaki, Musashino; Masaru Ogikubo, Kokubunji, all of Japan

[73] Assignee: Nippon Atsudenki Kabushiki Kaisha t/a Japan Piezo Co., Ltd., Tokyo, Japan

[21] Appl. No.: 594,302

[22] Filed: July 9, 1975

[51] Int. Cl.[2] ..... H04R 11/12

[52] U.S. Cl. ..... 179/100.41 K; 179/100.41 M; 179/100.41 Z

[58] Field of Search ..... 179/100.41 K, 100.41 Z, 179/100.41 M, 100.41 R

[56] References Cited

U.S. PATENT DOCUMENTS

| | | | |
|---|---|---|---|
| 3,067,295 | 12/1962 | Stanton | 179/100.41 Z |
| 3,184,555 | 5/1965 | Marshall | 179/100.41 K |
| 3,538,266 | 11/1970 | Cho | 179/100.41 K |
| 3,576,955 | 5/1971 | Obata | 179/100.41 M |
| 3,700,829 | 10/1972 | Anneberg et al. | 179/100.41 K |
| 3,761,647 | 9/1973 | Nemoto et al. | 179/100.41 K |

*Primary Examiner*—Raymond F. Cardillo, Jr.
*Attorney, Agent, or Firm*—Littlepage, Quaintance, Murphy, Richardson & Webner

[57] ABSTRACT

A stereophonic pickup cartridge includes both a rod-shaped armature and a disk-shaped armature, both of which magnetically interact with the pole pieces of coils to improve the magnetic efficiency of the cartridge.

8 Claims, 6 Drawing Figures

STEREOPHONIC PICKUP CARTRIDGE

BACKGROUND OF THE INVENTION

1. Field of the Invention

This invention relates to stereophonic pickup cartridges for simultaneously reproducing stereophonic recordings from a single-groove, two-channel record.

2. Description of the Prior Art

With reference to FIGS. 5 and 6, which represent prior art, the constructional features of one typical known stereophonic pickup cartridge are schematically shown. This pickup cartridge comprises four pole pieces, of which 21 is opposite to 22, and 23 to 24. Four coils, of which only 19 and 20 are shown for the sake of illustration, are wound on the four pole pieces respectively. A magnet armature 25 is movably supported by a damper member 26 in a magnetic gap formed by the pole pieces. The pickup cartridge comprises a cantilever 28 having one end equipped with a stylus 27 and the other end mounted integrally to the frontal end of the armature 25.

In such construction, it has been extremely difficult to locate the pole pieces 21 to 24 sufficiently close to the armature 25 and to reduce the length of the magnetic circuit, and thus magnetic efficiency remains low.

Furthermore, because the armature 25 is supported by the damper member 26 by way of planes, the fulcrum on which the armature 25 moves is indefinite, making it impossible to concentrate the mass of the vibration system at a point. This has set limitations on improvements in magnetic efficiency, frequency characteristic, cross-talk characteristic and distortion characteristic.

SUMMARY OF THE INVENTION

The invention provides a stereophonic pickup cartridge which is free of the prior art drawbacks. The stereophonic pickup cartridge of the invention operates like the conventional one in that, as in FIG. 5, the coil is kept energized by a bias current (i.e., a constant dc current) to magnetize the pole piece, and an output ac signal is induced across the coil as the armature moves relative to the pole piece.

BRIEF DESCRIPTION OF THE DRAWINGS

The method of operation of the pickup cartridge of the invention, free of the prior art drawbacks, will be described more specifically by referring to the figures.

DESCRIPTION OF THE PREFERRED EMBODIMENTS

Figure 1:
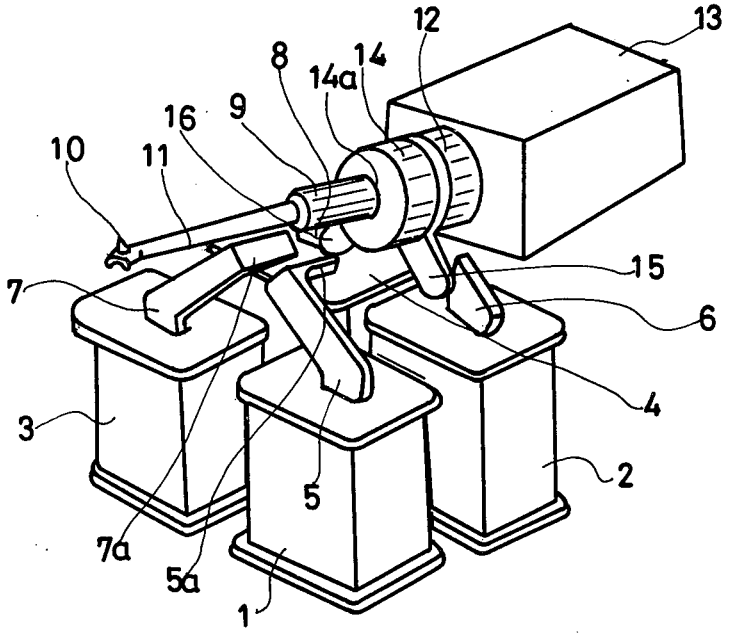
FIG. 1 is a perspective view showing the construction of one embodiment of the invention.

FIG. 1 schematically illustrates one embodiment of the invention, which comprises four coils. Coils 1 and 2 are connected in series to each other, and so are coils 3 and 4. Four pole pieces 5 to 8 are provided and have their base portions coupled to the coils 1 through 4 respectively. The pole pieces magnetically respond to the movement of an armature 9. The armature 9 is rod-shaped and is made of a magnet or of a material of high magnetic permeability. The front end of the armature is equipped with a cantilever 11 which has a stylus 10 at its tip end. The rear end of the armature is fitted to a support body 13 by way of a damper member 12. The positional relationship between the armature 9 and the pole pieces 5 and 7 is such that the bent portions **5*a* and 7*a* of pole pieces 5 and 7 are symmetrical with respect to the axis of the armature 9, or the bent portions 5*a* and 7*a* set up an isosceles triangle with the armature 9** being the vertex.

A magnetic disk armature 14 has an opening **14*a* in its center into which the rear end of the armature 9 is fitted integrally with the armature 14. This armature has lugs 15 and 16 diverging at an angle of about 90° in the directions perpendicular to the axis of the armature 9. These lugs are suitably spaced from the tip ends of the pole pieces 6 and 8** respectively.

This pickup cartridge operates in the following manner. When the stylus 10 vibrates as it tracks the sound groove on a record disk, the rod armature 9 moves toward and away from the bent portions **5*a* and 7*a* of pole pieces 5 and 7 to cause ac signals to be induced across the coils 1 and 3. Concurrently, the lugs 15 and 16 of disk armature 14 move toward and away from the pole pieces 6 and 8 to cause ac signals to be induced across the coils 2 and 4. Thus the two pairs of coils 1 and 2, and 3 and 4**, each pair of coils being connected in series to each other, offer in combination a pair of output signals each consisting of two ac signals induced in the manner described above.

Figure 3:
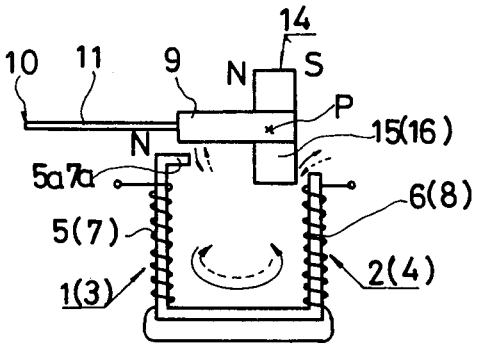
FIG. 3 is a schematic diagram useful for illustrating the operating principles of the embodiment shown in FIG. 1.

The operating principles of the pickup cartridge shown in FIG. 1 are schematically illustrated in FIG. 3. The arrow-marked semi-circular solid and broken lines indicate the directions in which the magnetic flux flows when the rod armature 9 and disk armature 14 move about the fulcrum P as the stylus 10 moves, and the other arrow-marked solid and broken lines indicate the directions in which the two armatures move as the stylus moves. The fulcrum P may be formed, for example, by installing a pin in the center of the damper member 12 in contact with the disk armature 14.

Figure 2:
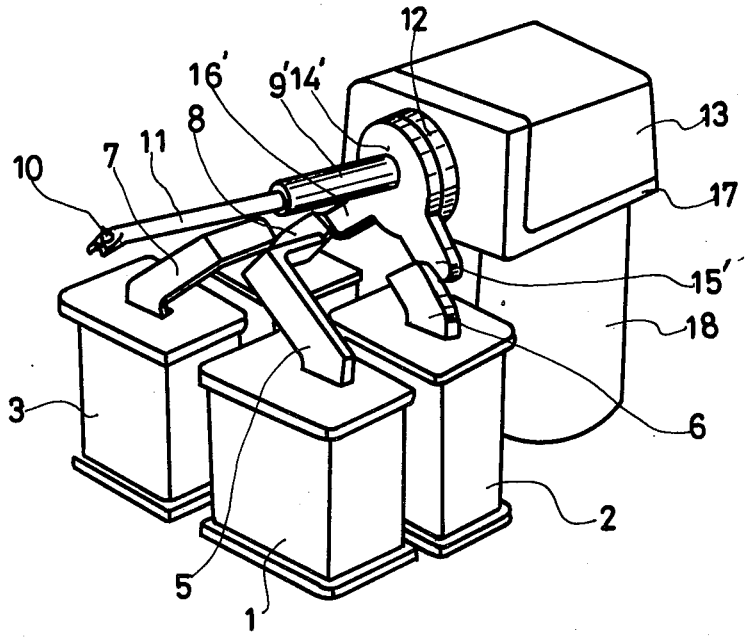
FIG. 2 is a perspective view showing the construction of another embodiment of the invention.

FIG. 2 schematically illustrates another embodiment of the invention. This pickup cartridge comprises a rod armature 9' and a disk armature 14' both of which are made of a material of high magnetic permeability. These armatures are mounted to a support body 13 by way of a damper member 12 and one side of an L-shaped metal member 17 which is made of a material of high magnetic permeability. A magnet 18 is mounted to another side of the metal member 17 and exerts magnetic forces upon the armatures 9' and 14' by way of the L-shaped metal member 17.

Figure 4:
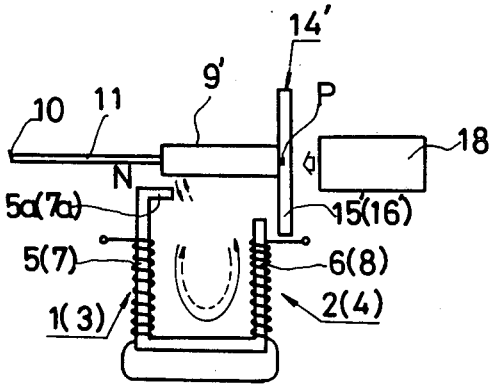
FIG. 4 is a schematic diagram useful for illustrating the operating principles of the embodiment shown in FIG. 2.

This pickup cartridge operates like the previous one on the principles schematically illustrated in FIG. 4. The arrow-marked semi-circular solid and broken lines indicate the directions in which the magnetic flux flows when the rod armature 9' and dish armature 14' move about the fulcrum P as the stylus 10 moves, and the other arrow-marked solid and broken lines indicate the directions in which the two armatures move with the movement of the stylus 10. Both armatures become magnetic, not by themselves, but by induction from the magnet 18. As a result, the two armatures together assume one polarity, such as N-polarity as shown in FIG. 4, causing the disk armature 14' to be located outside the pole piece 6(8), as opposed to the one shown in FIG. 3.

In the foregoing embodiments, four coils are used. However, the invention encompasses embodiments which use only two coils.

Figure 5:
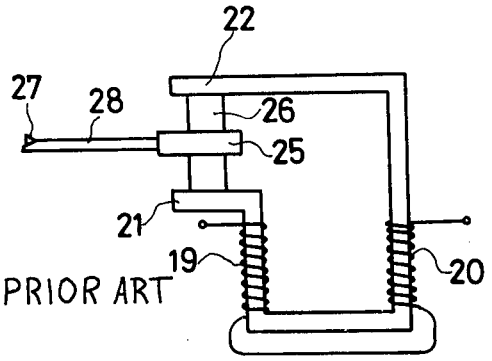
FIG. 5 is a schematic diagram showing features of one prior art stereophonic pickup cartridge.
Figure 6:
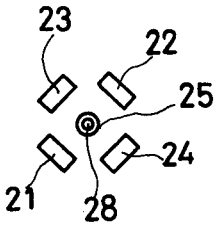
Fig. 6 PRIOR ART
FIG. 6 is a frontal plan view of FIG. 5 viewed at an angle of 45°.

According to the invention, as has been described above, the armatures move about a point fulcrum to make it possible to concentrate the mass of the vibration system at one point, quite dissimilar from the prior art construction shown in FIGS. 5 and 6. In other words, the pickup cartridge of the invention can offer a much better magnetic characteristic, frequency characteristic, cross-talk characteristic and distortion characteristic than can conventional pickup cartridges of a similar type. Furthermore, according to the invention, a gap between the stylus tip and the record disk can easily be set and the length of the cantilever can therefore be reduced, thus enabling the whole cartridge mass to be minimized.

What is claimed is:

1. A pick-up cartridge comprising:

A. first and second pairs of coils, each pair of coils being electrically connected in series, B. each pair of coils being respectively coupled to a pair of pole pieces including pole pieces of respectively first and second types, each pole piece having base portions coupled to said coils.

C. a rod-shaped armature integral with a cantilever having its tip end equipped with a stylus, D. each pair of pole pieces including one pole piece of the first type having one portion which extends from its associated coil toward the rod-shaped armature and a bent portion which runs approximately parallel to the rod-shaped armature, the bent portion from one pair of pole pieces being arranged symmetrically and displaced by approximately 90° with respect to the bent portion of the pole piece of the first type in the other pair of pole pieces, E. a disk-shaped armature installed at the base of the rod-shaped armature and perpendicular to the axis of the rod-shaped armature, the disk-shaped armature including a pair of lugs arranged symmetrically and displaced by approximately 90° with respect to each other, F. each pole piece of the second type being situated at a short distance from a respective lug, and G. support means for supporting the armatures so that the rod-shaped armature moves toward and away from the bent portions of the pole pieces of the first type while never coming between the two pole pieces of any pair and so that the lugs of the disk-shaped armature move toward and away from the pole pieces of the second type.

2. A pick-up cartridge according to claim 1 wherein the pole pieces of the second type are on a side of the respective lugs adjacent to the pole pieces of the first type, whereby there are no parts of the armature within the air gap at any time.

3. A pick-up cartridge according to claim 2 wherein both the rod-shaped armature and the disc-shaped armature are made of a material of high magnetic permeability.

4. A pick-up cartridge according to claim 3 further comprising a magnetic member situated to induce magnetic forces in both of said armatures.

5. A pick-up cartridge according to claim 1 wherein the pole pieces of the second type are on a side of the respective lugs remote from the pole pieces of the first type.

6. A pick-up cartridge according to claim 5 wherein the rod-shaped armature is made of permanently magnetized material.

7. A pick-up cartridge according to claim 6 wherein the disc-shaped armature is made of a material of high magnetic permeability.

8. A pick-up cartridge according to claim 6 wherein the disc-shaped armature is made of permanently magnetized material.

* * * * *